US006908079B2

(12) United States Patent
Milillo et al.

(10) Patent No.: US 6,908,079 B2
(45) Date of Patent: Jun. 21, 2005

(54) COMPILING PLATFORM TO ENABLE SHEET AND SET COMPILING AND METHOD OF USE

(75) Inventors: Richard J. Milillo, Fairport, NY (US); William D. Milillo, Ontario, NY (US); Steven D. Olson, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 53 days.

(21) Appl. No.: 10/604,013

(22) Filed: Jun. 20, 2003

(65) Prior Publication Data

US 2004/0256782 A1 Dec. 23, 2004

(51) Int. Cl.[7] ..... B65H 37/04

(52) U.S. Cl. ..... 270/58.08; 270/58.18; 270/58.12; 270/58.11; 399/410; 414/791.2

(58) Field of Search ..... 270/58.08, 58.11, 270/58.12, 58.14, 58.16, 58.18; 399/410; 271/213; 414/791.2

(56) References Cited

U.S. PATENT DOCUMENTS

| | | | | |
|---|---|---|---|---|
| 4,473,425 A | * | 9/1984 | Baughman et al. | 156/356 |
| 4,611,741 A | * | 9/1986 | Wilson | 227/99 |
| 4,871,158 A | | 10/1989 | May et al. | |
| 5,513,839 A | | 5/1996 | Green | |
| 5,642,876 A | | 7/1997 | Ferrara et al. | |
| 5,649,695 A | | 7/1997 | Lawrence | |
| 6,003,862 A | | 12/1999 | Russell et al. | |
| 6,120,015 A | | 9/2000 | Albright et al. | |
| 6,231,039 B1 | * | 5/2001 | Chung | 270/58.01 |
| 6,330,999 B2 | * | 12/2001 | Coombs et al. | 270/58.18 |
| 6,450,492 B1 | * | 9/2002 | Coombs et al. | 270/58.08 |
| 6,722,650 B1 | * | 4/2004 | Abbata et al. | 271/213 |
| 6,776,404 B1 | * | 8/2004 | Milillo et al. | 270/58.18 |

OTHER PUBLICATIONS

U.S. Appl. No. 10/361,345, filed Feb. 2003, Milillo et al.
U.S. Appl. No. 10/248,822, filed Feb. 2003, Abbata et al.
U.S. Appl. No. 10/249,644, filed Apr. 2003, Brumberger et al.

* cited by examiner

*Primary Examiner*—Patrick Mackey
(74) *Attorney, Agent, or Firm*—Oliff & Berridge, PLC

(57) ABSTRACT

Substrates are received by a compiling mechanism and compiled into sets. Incoming sheets are tamped by a tamping system into position on the compiling platform to register the sheets. The compiler platform mechanism includes two narrow, low-friction panels that are driven in opposite directions. The compiled and registered sheets sets can be manipulated by a manipulation device, to be stapled, punched, stitched, etc. The compiled, manipulated and registered sheet sets can be dropped onto an output catch platform located below the compilation platform. The compiling platform includes two retractable panels that slide open to allow the compiled set to drop to the output catch platform below. Once the set is dropped, the compiling platform panels are driven back to their original position in order to receive another set. Alternatively, the compiled and registered sets can be ejected from the compiling platform to a subsequent, downstream device.

19 Claims, 4 Drawing Sheets

COMPILING PLATFORM TO ENABLE SHEET AND SET COMPILING AND METHOD OF USE

BACKGROUND OF THE INVENTION

1. Field of the Invention

This invention is directed to systems and methods for compiling sheets for a printing system.

2. Description of Related Art

A variety of methods are conventionally used to handle and compile substrates, such as, for example, copy sheets, in printing systems, such as, for example, copiers, printers, and facsimile machines. Such methods include registering and stacking substrates. Registration, or alignment, is critical to handling and compiling sets of sheets, in that registering the sheets ensures accurate and high quality image transfer and manipulation of substrates, both individually and in sets, during the printing process.

In many printers, copiers and the like, for example, that have handling and compiling systems, trays are often used to compile the copy sheets, either individually or in stacks. As is well known in the handling and compiling art, tamping systems are commonly utilized to register the sheets in such compiler trays. Walls or tamper arms on the sides of the tray can be moved repeatedly and reversibly against one or more sides of an incoming sheet or of a set of sheets, thereby achieving proper alignment and square stacking. Once squared, stacks of sheets can be more accurately manipulated, for example stapled or hole-punched, during the finishing stages of the printing or copying process.

Finished sheet stacks are often output to an output stacking tray. Methods of offsetting, or deliberate irregular stacking multiple sets of sheets, can be employed for efficient stacking of compiled sets. Such methods of offsetting are well known to those in the art.

U.S. Pat. No. 6,003,862 to Russell et al. discloses a simplified and low-cost tamper usable to compile sheets in various stacker or finisher applications. Additionally, U.S. Pat. No. 5,513,839 to Green discloses an output system for tamping and stacking sheet sets both in offset and standard stacking arrangements.

SUMMARY OF THE INVENTION

Today's photocopying systems, especially high-volume, high productivity finishing devices, strive to provide flexibility, improved service and greater productivity and reliability. In the pursuit of greater automation and productivity, copying and finishing sheets into sets has led to systems that are more complex. This, in turn, has led to greater costs and physically larger systems. Advancements within photocopying systems, such as paper handling and compiling, are needed to help reduce the architectural footprint and the overall cost of such photocopying systems.

This invention provides systems and methods for compiling and/or manipulating substrates for a photocopying system.

This invention separately provides systems and methods for registering substrates.

This invention separately provides systems and methods for dropping substrate sets onto an output catch platform.

In various exemplary embodiments of the systems and methods of this invention, substrates are received by a compiling mechanism and compiled into sets. In various exemplary embodiments, incoming sheets are tamped into position on the compiling platform to register sheets. In various exemplary embodiments, registration can be accomplished using a tamping system. In various exemplary embodiments, the compiling and tamping mechanism includes two narrow, low-friction panels that are driven in opposite directions by a system of belts and shafts connected to a motor.

In various exemplary embodiments of the systems and methods of this invention, compiled and registered sheets sets are manipulated by a manipulation device. In various exemplary embodiments, the sets of sheets can be stapled, punched, and/or stitched, for example, by the manipulation device.

In various exemplary embodiments of the systems and methods of this invention, compiled and registered sheet sets can be dropped onto an output catch platform located below the compilation platform. In various exemplary embodiments, the output catch platform can be a tray, for example. In various exemplary embodiments, the bottom of the compiling platform includes two retractable panels that slide open, allowing the compiled set to drop to the output catch platform below. Once the set is dropped, the compiling platform panels are driven back to their original position in order to receive another set.

In various exemplary embodiments of the systems and methods according to this invention, compiled and registered sets can alternatively be ejected from the compiling platform to a subsequent, downstream device.

These and other features and advantages of this invention are described in, or are apparent from, the following detailed descriptions of various exemplary embodiments of the systems and methods according to this invention.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Various exemplary embodiments of the systems and methods according to this invention enable the compilation and manipulation of sets of substrates, such as, for example, copy sheets in a printing or copying system, by using a substrate compiling platform. In various exemplary embodiments, the mechanisms and techniques used by substrate compiling platforms according to this invention provide a combination of compilation and manipulation.

The following detailed description of various exemplary embodiments of the substrate-compiling platform according to this invention may refer to one specific type of substrate, copy sheets, for the sake of clarity and familiarity. Further, for the sake of clarity and familiarity, this invention may refer to one specific type of image format device, a copier. However, it should be appreciated that the principles of this invention, as outlined and/or discussed below, can be equally applied to any known or later-developed substrate or image forming device, beyond any copy sheets and/or copiers specifically discussed herein.

In various exemplary embodiments of the systems and methods of this invention, sheets fed into a finisher module of a copier can be effectively compiled and manipulated based upon the requirements of a particular job submitted by an operator of the copier. It should be appreciated that, in various exemplary embodiments, sheets requiring no manipulation are able to bypass the finisher module and can be transferred to a downstream module or system, such as for example, a stacking tray.

In various exemplary embodiments, the sheets transported to the compiling platform are registered by a series of trailing and/or side tamper devices. Such trailing end and/or side edge tamping devices ensure proper alignment of the sheet sets prior to manipulation.

In various exemplary embodiments, sheets of varying lengths and sizes can be compiled on the compiling platform. It should be appreciated that compiled sheets of the same and/or varying sizes can be compiled and/or manipulated. Manipulation includes one or more of, but is not limited to, stapling, punching, perforating, and/or stitching.

In various exemplary embodiments, sets of sheets, whether manipulated or not, are dropped from the compiling platform onto an output catch platform positioned below the compiling platform. It should be appreciated that, in various exemplary embodiments, compiled sheets, whether manipulated or not, may be output from the compiling platform to a downstream module or device.

Figure 1:
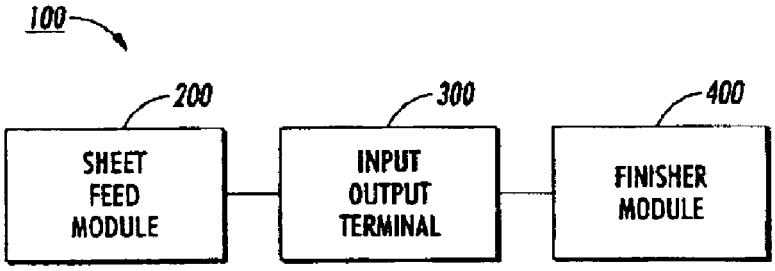
FIG. 1 is a block diagram illustrating one exemplary embodiment of a printing system useable with various exemplary embodiments of the systems and methods according to this invention.

FIG. 1 is a block diagram of one exemplary embodiment of a copying system 100 useable form images onto sheets and to compile and manipulate a set of such sheets. As shown in FIG. 1, the printing 100 includes a sheet feed module 200, an image output terminal 300, and a finisher module 400.

It should be appreciated that these elements, the sheet feed module 200, the image output terminal 300, and the finisher module 400 shown in FIG. 1, while depicted separately, are not necessarily separate and distinct components. Thus, the function and/or operations of any two or more of these elements may be carried out by a single device, structure and/or system. Further, it should be appreciated that additional devices, structures, and or systems may be included in the copying system 100 such as, for example, a sheet preparation module.

Figure 2:
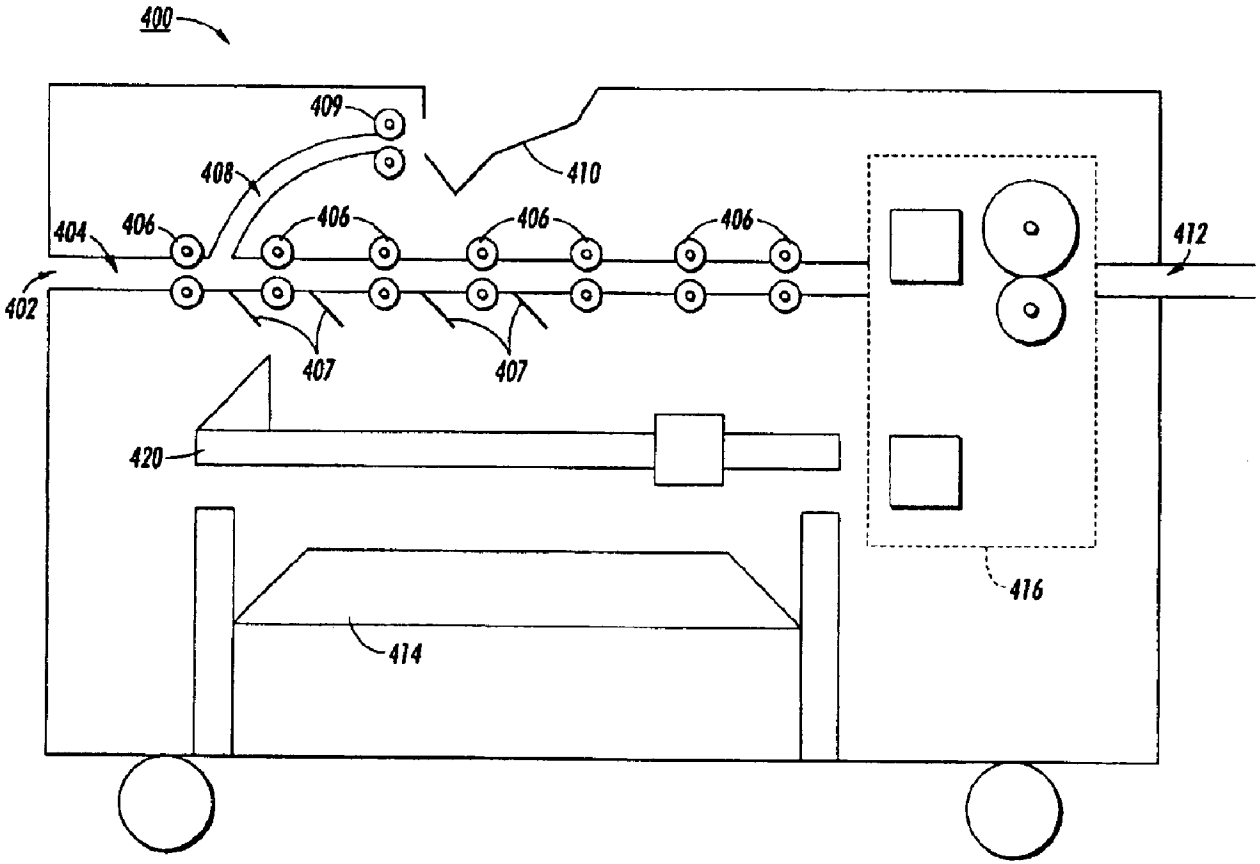
FIG. 2 is a schematic diagram illustrating one exemplary embodiment of the finisher module useable with various exemplary embodiments of systems and methods according to this invention.

FIG. 2 illustrates one exemplary embodiment of the finisher module 400.

As shown in FIG. 2, the finisher module 400 includes a sheet receiving inlet 402, a main transport path 404, a bypass transport path 408, a bypass or top output tray 410, and a discharging outlet 412. A number of pairs of transport nip rollers 406 move the sheets along the main transport path 404. As shown in FIG. 2, the finisher module 400 also includes a compiling platform 420, an output catch platform 414, and a manipulation device 416.

Sheets to be compiled into sets are transported along the main transport path 404 by the pairs of transport nip rollers 406. Sheets are diverted from the main transport path 404 to the compiling platform 420 by opening an appropriate one of the one or more gates 407. The particular gate 407 to be opened, if more than one gate 407 is provided, generally depends on a length of the sheet to be compiled.

Sheets to be compiled into sets are diverted from the main transport path 404 to the compiling tray 420. In contrast, sheets that are not to be compiled can be moved along the main transport path 404 to the discharge outlet 412 to be output to a downstream module. Alternatively, if neither compiling nor any downstream processing is required or desired for a given sheet, that sheet can be diverted to the bypass path 408, where a pair of bypass nip rollers 409 output that sheet to the top output or bypass tray 410.

Once in the compiling tray 420, the sheets are registered in the compiling tray 420 using some or all of at least a trail edge tamper and one or more side tampers. After a sheet has been registered and properly aligned, the next sheet is diverted from the main transport path 404 to the compiling tray 420. This process is repeated until all of the sheets of a particular set of sheets are compiled in the compiling tray 420. After all of the sheets of a particular set of sheets are compiled in the compiling tray 420, that set of sheets can be manipulated by the manipulating device 416. If the manipulation device 416 is a stapler, for example, the lead edge of the set that had been compiled and registered is set in the throat of the stapler and the set is stapled. The set of sheets is ejected out of the manipulation device 416 and the compiler platform 420 is opened, dropping the set to the output catch platform 414 below. Once the compiled, and optionally manipulated, set of sheets is dropped, the compiler platform 420 is ready to receive the next set of sheets. This process is continued until the desired number of sets of sheets is compiled and, optionally manipulated.

The compiled and optionally manipulated sets of sheets are extracted by the operator from the catch platform 414. It should be appreciated, however, that one or more manipulated sets can be ejected from the compiling platform 420 through the discharge outlet 412 to a downstream module. Further, the compiling platform 420 can compile and register a set of sheets in a large homogeneous stack that is not manipulated, i.e., stapled, punched, perforated, and/or the like. This homogeneous and registered set of sheets can also be dropped to the catch platform 414.

Figure 3:
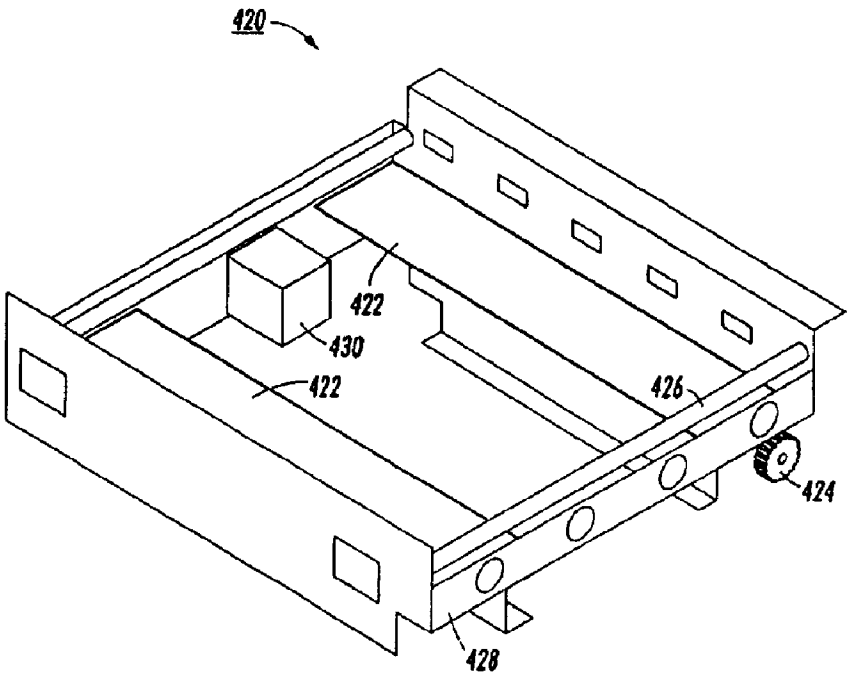
FIG. 3 is a schematic diagram outlining in greater detail one exemplary embodiment of a substrate compiling platform according to this invention.

FIG. 3 shows in greater detail one exemplary embodiment of the compiling platform 420. As shown in FIG. 3, the compiling platform 420 includes a pair of compiler panels 422, a motor assembly 424, a number of guide shafts 426, and a drive belt/pulley system 428. As shown in FIG. 3, the compiling platform 420 also includes a trailing edge tamper 430.

As shown in FIG. 3, the compiling platform 420 uses two retractable panels 422 that travel in a cross-process, horizontal plane direction. Sheets that are being compiled into sets are deposited on top of the compiler panels 422. Upon being deposited on top of the compiler panels 422, the sheet is registered, i.e., aligned, onto the platform and/or previous sheet or sheets by the trail edge tamper 430 and side-edge tampers. In various exemplary embodiments, the side-edge tamping of sheets is accomplished using the compiler panels 422. Both compiler panels 422 are retracted in and out by the timing belt/drive pulley system 428, which is driven by the motor assembly 424. This timing belt drive pulley system 428 is located at both ends of the compiling platform 420. The two compiler panels 422 are synchronized to move together, which can be used to achieve side-edge tamping, along a drive shaft 426 of the timing belt drive pulley system 428. The drive shaft 426 is driven by the motor assembly 424.

In various exemplary embodiments, the compiler panels 422 use sliding type "U" shaped bearings (two at each end of the panels) which slide and are guided on the drive shafts 426 located at each end of the compiler panels 422.

In operation, once the set of sheets is compiled and registered, the leading edge of the set is manipulated. For example, sets that are stapled may have the leading edge of the set moved into the throat of the stapler by the trail edge tamper 430, enabling the stack to be stapled. In various other exemplary embodiments, the leading edges of the sheets in the set are registered in the first instance by tamping them against an element of the manipulation device 416. For example, if the manipulation device 416 is a stapler, the set of sheets are tamped against the throat of the stapler. As a result, in such exemplary embodiments, the set of sheets can be immediately manipulated without having to move the set of sheets relative to the manipulation device 416 for at least one type of manipulation. It should be appreciated that the designs of the finisher module 400 that uses the compiling platform 420 and of the manipulator device 416 may vary and would be obvious to those skilled in the art.

Depending on the operation of the manipulation device 440, the set of sheets is ejected from the manipulation device 416 back onto the compiler panels 422 of the compiling platform 420 and the compiler panels 422 are quickly opened. As a result, the set drops to the catch tray 414 below. The compiler panels 422 are then driven back to receive the next set. In various exemplary embodiments, an ejection device of the manipulation device 416 is used to move the set of sheets out of the manipulation device 416 after manipulation.

Figure 4:
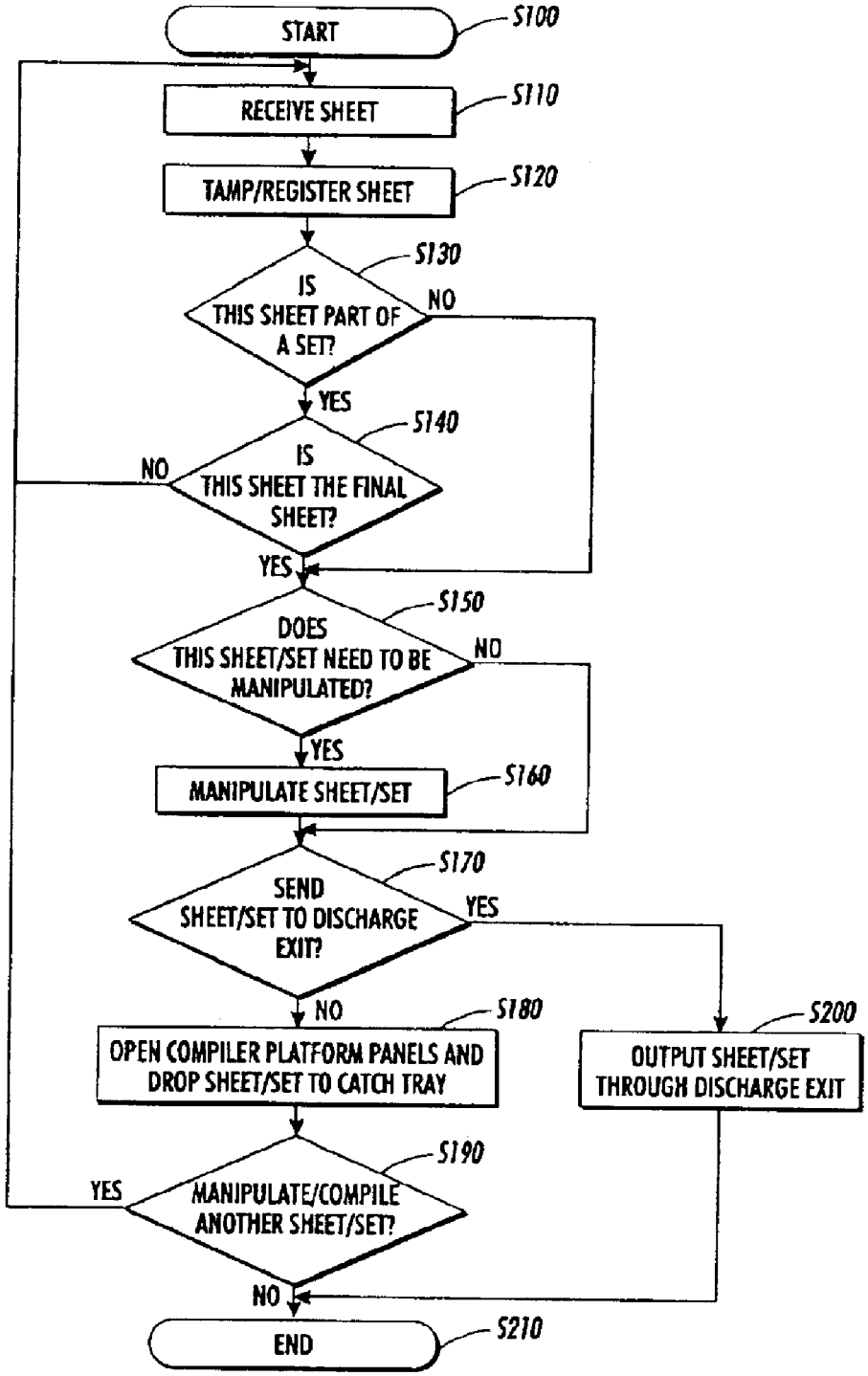
FIG. 4 is a flowchart outlining one exemplary embodiment of a method for compiling a substrate set using the substrate-compiling platform according to this invention.

FIG. 4 is a flowchart outlining one exemplary embodiment of a method for compiling and manipulating a sheet set using the compiling platform 420. Beginning in step S100, operation continues to step S110, where the compiling platform 420 receives a sheet. Then, in step S120, the received sheet is registered by tamping against one or more edges of the received sheet and any previously-received sheets. Next, in step S130, a determination is made whether the sheet is part of a set. If the sheet is part of a set, operation continues to step S140. Otherwise, operation jumps to step S150.

In step S140, a determination is made whether the sheet is the final sheet of a set. If the sheet is the final sheet of the set, operation continues to step S150. Otherwise, operation returns to S110. In step S150, a determination is made whether the single sheet or the completed set, whichever is appropriate, is to be manipulated. If the single sheet/completed set is to be manipulated, operation continues to step S160. Otherwise, operation jumps directly to step S170. In step S160, the single sheet/completed set is manipulated. Operation then continues to step S170, where a determination is made whether the single sheet/completed set needs to exit the finisher to a downstream module. If the single sheet/completed set does not need to be output to a downstream module, operation continues to step S180. Otherwise, operation jumps to step S200.

In step S180, the compiler platform 420 drops the single sheet/completed set to the catch platform 414. Next, in step S190, a determination is made whether another single sheet or another set of sheets needs to be manipulated and/or compiled. If another single sheet or set is to be manipulated and/or compiled, operation jumps back to step S110. Otherwise, operation jumps to step S210.

In contrast, in step S200, the single sheet/completed set is output to a downstream module through the discharge outlet 412. Operation then continues to step S210, where the operation of the method ends.

While this invention has been described in conjunction with various exemplary embodiments, it is to be understood that many alternatives, modifications and variations would be apparent to those skilled in the art. Accordingly, the preferred embodiments of this invention, as set forth above are intended to be illustrative, and not limiting. Various changes can be made without departing from the spirit and scope of this invention.

What is claimed is:

1. A substrate-compiling device usable to compile a number of substrates, comprising:

an input path usable to receive a substrate to be compiled, the input path defining a process direction for the substrate;

a compiler platform usable to receive the substrate to be compiled from the input path and to compile the received substrate into a set of at least one substrate;

at least one gate usable to direct the received substrate from the input path to the compiler platform;

a stack platform positioned below the compiler platform usable to receive the compiled set of at least one substrate, wherein the compiler platform comprises:

a first shelf member, and a second shelf member, wherein the first and second shelf members define a surface on which the received substrate is compiled onto, the first and second shelf members movable away from each other along a shelf-moving direction having a perpendicular translation component to the process direction of the substrate to allow the compiled set of at least one substrate to drop to the stack platform; and a manipulation device usable to manipulate the compiled set of at least one substrate before the compiled set of at least one substrate is dropped to the stack platform, wherein the manipulation device includes a registration surface, the substrate-compelling device further comprising a tamper device usable to tamp against a trailing edge of the received substrate when the received substrate is compiled onto the surface to drive a leading edge of the received substrate against the registration surface of the manipulation device.

2. The substrate-compiling device of claim 1, wherein the first and second shelf members each include a tamping surface usable to tamp against a side edge of the received substrate when the received substrate is compiled onto the surface to laterally align the compiled set of at least one substrate.

3. The substrate-compiling device of claim 2, wherein the first and second shelf members are moved laterally back and forth along the shelf-moving direction to tamp against the side edges of the received substrate.

4. The substrate-compiling device of claim 3, wherein the first and second shelf members are moved away from each other a distance to allow the compiled set of at least one substrate to drop onto the stack platform and arc moved away from each other less than the distance when moving laterally back and forth along the shelf-moving direction to tamp against the side edges of the received substrate.

5. The substrate-compiling device of claim 1, wherein the manipulation device is at least one of a stapler, a hole punch, and a substrate perforator.

6. The substrate-compiling device of claim 1, wherein the manipulation device is further usable to manipulate the compiled set of at least one substrate registered against the registration surface without having to move the compiled set of at least one substrate along the process direction before manipulating the substrate.

7. The substrate-compiling device of claim 6, wherein the manipulation device further comprises an ejection device usable to move the compiled set of at least one substrate away from the registration surface and out of the manipulation device, such that the first and second shelf members can be moved away from each other along the shelf-moving direction to allow the compiled set of at least one substrate to drop to the stack platform.

8. The substrate-compiling device of claim 1, wherein the first and second shelf members are movable away from each other by swinging along an axis substantially perpendicular to the surface on which the substrate is compiled.

9. A substrate-compiling device usable to compile a number of substrates, comprising:

an input path usable to receive a substrate to be compiled, the input path defining a process direction for the substrate;

a compiler platform usable to receive the substrate to be compiled from the input path and to compile the received substrate into a set of at least one substrate;

at least one gate usable to direct the received substrate from the input path to the compiler platform;

a stack platform positioned below the compiler platform usable to receive the compiled set of at least one substrate, wherein the compiler platform comprises:

a first shelf member, and a second shelf member, wherein the first and second shelf members define a surface on which the received substrate is compiled onto, the first and second shelf members movable away from each other alone a shelf-moving direction having a perpendicular translation component to the process direction of the substrate to allow the compiled set of at least one substrate to drop to the stack platform; and a tamper device usable to tamp against a trailing edge of the received substrate when the received substrate is compiled onto the surface to drive a leading edge of the received substrate against a registration surface of the compiling device.

10. A method for compiling a substrate into a set of at least one substrate, comprising:

receiving the substrate at an input of a substrate-compiling device, the substrate traveling along a process direction;

directing the received substrate onto a compiler platform comprising a first shelf member and a second shelf member that define a compiling surface;

compiling the received substrate and zero, one or more other substrates into a compiled set of at least one substrate;

moving the first and second shelf members away from each other along a shelf-moving direction having a translation component that is perpendicular to the process direction to allow the compiled set of at least one substrate to drop onto a stack platform that is positioned below the compiler platform; and tamping against a trailing edge of the received substrate when the received substrate is compiled onto the compiling surface to drive a leading edge of the received substrate against a registration surface of the compiling device.

11. The method of claim 10, wherein the first and second shelf members each includes a tamping surface, the method further comprising tamping the tamping surfaces of the first and second shelf members against the side edges of the received substrate when the received substrate is compiled onto the compiling surface to align the received substrate.

12. The method of claim 11, wherein the tamping surfaces of the first and second shelf members against the side edges of the received substrate when the received substrate is compiled onto the compiling surface comprises moving the first and second shelf members laterally back and forth along the shelf-moving direction to tamp the tamping surfaces against the side edges of the received substrate.

13. The method of claim 12, wherein:

moving the first and second shelf members away from each other along a shelf-moving direction that is perpendicular to the process direction to allow the compiled set of at least one substrate to drop to a stack platform comprises moving the first and second shelf members away from each other by a distance; and moving the first and second substrates back and forth along the shelf-moving direction to tamp against the received substrate comprises moving the first and second shelf members away from each other less than the distance when moving laterally back and forth along the shelf-moving direction.

14. The method of claim 10, further comprising manipulating the compiled set of at least one substrate before dropping the compiled set of at least one substrate to the stack platform.

15. The method of claim 14, wherein the substrate-compiling device includes a manipulation device having a registration surface, the method further comprising:

tamping against a trailing edge of the received substrate when the received substrate is compiled onto the compiling surface to drive a leading edge of the received substrate against the registration surface of the manipulation device.

16. The method of claim 15, further comprising manipulating the compiled set of at least one substrate using the manipulation device without having to first move the compiled set of at least one substrate along the process direction before manipulating the substrate.

17. The method of claim 16, further comprising ejecting the compiled set of at least one substrate away from the registration surface, out of the manipulation device and onto the compiling surface, such that the first and second shelf members can be moved away from each other along the shelf-moving direction to allow the compiled set of at least one substrate to drop to the stack platform.

18. The method of claim 14, wherein manipulating the compiled set of at least one substrate comprises at least one of at least stapling the compiled set of at least one substrate at least once, punching at least one hole into the compiled set of at least one substrate, and creating at least one perforation in at least one substrate of the compiled set of at least one substrate.

19. The method of claim of claim 10, wherein moving the first and second shelf members away from each other further includes swinging along an axis substantially perpendicular to the surface on which the substrate is compiled.

* * * * *